United States Patent [19]

Hofler et al.

[11] Patent Number: 4,722,201

[45] Date of Patent: Feb. 2, 1988

[54] ACOUSTIC COOLING ENGINE

[75] Inventors: Thomas J. Hofler; John C. Wheatley, both of Los Alamos; Gregory W. Swift; Albert Migliori, both of Santa Fe, all of N. Mex.

[73] Assignee: The United States of America as represented by the United States Department of Energy, Washington, D.C.

[21] Appl. No.: 942,049

[22] Filed: Dec. 16, 1986

Related U.S. Application Data

[63] Continuation of Ser. No. 829,346, Feb. 13, 1986, abandoned.

[51] Int. Cl.[4] ..... F25B 9/00

[52] U.S. Cl. ..... 62/467; 62/6; 60/516

[58] Field of Search ..... 62/6, 467, 514; 60/516, 60/517, 658, 669, 682, 671

[56] References Cited

U.S. PATENT DOCUMENTS

| | | | |
|---|---|---|---|
| 2,836,033 | 5/1958 | Marrison | 60/516 |
| 3,237,421 | 3/1966 | Gifford | 62/6 X |
| 4,489,553 | 12/1984 | Wheatley et al. | 62/467 X |

OTHER PUBLICATIONS

John Wheatley et al., "Natural Engines," Physics Today (Aug. 1985).

*Primary Examiner*—Lloyd L. King

*Attorney, Agent, or Firm*—Lee W. Huffman; Paul D. Gaetjens; Judson R. Hightower

[57] ABSTRACT

An acoustic cooling engine with improved thermal performance and reduced internal losses comprises a compressible fluid contained in a resonant pressure vessel. The fluid has a substantial thermal expansion coefficient and is capable of supporting an acoustic standing wave. A thermodynamic element has first and second ends and is located in the resonant pressure vessel in thermal communication with the fluid. The thermal response of the thermodynamic element to the acoustic standing wave pumps heat from the second end to the first end. The thermodynamic element permits substantial flow of the fluid through the thermodynamic element. An acoustic driver cyclically drives the fluid with an acoustic standing wave. The driver is at a location of maximum acoustic impedance in the resonant pressure vessel and proximate the first end of the thermodynamic element. A hot heat exchanger is adjacent to and in thermal communication with the first end of the thermodynamic element. The hot heat exchanger conducts heat from the first end to portions of the resonant pressure vessel proximate the hot heat exchanger. The hot heat exchanger permits substantial flow of the fluid through the hot heat exchanger. The resonant pressure vessel can include a housing less than one quarter wavelength in length coupled to a reservoir. The housing can include a reduced diameter portion communicating with the reservoir. The frequency of the acoustic driver can be continuously controlled so as to maintain resonance.

21 Claims, 11 Drawing Figures

ACOUSTIC COOLING ENGINE

This invention is the result of a contract with the Department of Energy (Contract No. W-7405-ENG-36).

This is a continuation of application Ser. No. 06/829,346 filed Feb. 13, 1986, now abandoned.

BACKGROUND OF THE INVENTION

The invention described herein relates generally to heat pumping and refrigerating engines and more particularly to acoustic cooling engines.

U.S. Pat. No. 4,489,553 to Wheatley et al. discloses an intrinsically irreversible heat engine. The engine is intrinsically irreversible because it uses heat transfer processes which are intrinsically irreversible in the thermodynamic sense, in contrast to a conventional heat engine which approaches optimum efficiency as the heat transfer processes become increasingly reversible. The intrinsically irreversible heat engine comprises a first thermodynamic medium, such as a fluid, and a second thermodynamic medium, such as a set of parallel plates, which are in imperfect thermal contact with each other and which bear a broken thermodynamic symmetry with respect to each other. U.S. Pat. No. 4,489,553 is expressly incorporated by reference herein for all that it teaches and is hereafter referred to as the '553 patent.

As a heat pump or refrigerator, the intrinsically irreversible heat engine includes a driver for effecting a reciprocal motion of the fluid at a frequency which is approximately inversely related to the thermal relaxation time of the fluid relative to the plates. This motion, together with the cyclic variation in temperature and pressure of the fluid, results in the pumping of heat along the plates and the concomitant generation of a temperature difference along the length of the plates.

The acoustic heat pumping engine disclosed in the '553 patent comprises a housing which can be either a straight, J-shaped or U-shaped tube. One end of the housing is capped and the other end is closed by a diaphragm and voice coil, which serve as an acoustic driver for generating an acoustic wave within the housing. The housing is filled with a compressible fluid, such as a gas, capable of supporting an acoustic standing wave. The plates are located within the housing near the capped end. Different parts of the plates receive heat at different rates from the gas moved therethrough during the time of increasing pressure of a wave cycle, and give up heat at different rates to the gas as the pressure of the gas decreases during the appropriate part of the wave cycle. The imperfect thermal contact between the gas and the plates results in a phase lag different from 90° between the local gas temperature and its local velocity. As a result there is an acoustically stimulated heat pumping action which results in a temperature difference along the length of the plates. The ends of the plates nearest the driver become cold and the ends of the plates farthest from the driver become hot.

A major technical problem with the acoustic heat pumping engine disclosed in the '553 patent is that there is acoustically driven convective motion within the housing resulting in thermal communication between the cold ends of the plates and the ambient temperature environment at the driver end of the housing. This thermal communication limits the low temperature achievable at the cold ends of the plates, which have only been cooled to a temperature near 0° C. in practice. It is therefore desirable to design an acoustic cooling engine capable of reaching lower temperatures. The '553 patent disclosed a quarter wavelength long resonant housing with plates located at the far end of the housing from the acoustic driver. Now we have discovered that an effectively half wavelength resonant pressure vessel is operable and that better performance is achieved with a thermodynamic element, such as a set of plates, located proximate the acoustic driver.

SUMMARY OF THE INVENTION

One object of the present invention is to provide an improved acoustic cooling engine with increased efficiency.

Another object of the invention is to eliminate the undesirable thermal communication between an acoustic driver and the cold end of a thermodynamic element.

Yet another object of the invention is to cool a load with an acoustic cooling engine.

Still another object of the invention is to reach lower temperatures than previously achieved with acoustic cooling engines.

To achieve the foregoing and other objects, and in accordance with the purposes of the present invention, as embodied and broadly described herein, there is provided an acoustic cooling engine that comprises a resonant pressure vessel. A compressible fluid having a substantial thermal expansion coefficient and being capable of supporting an acoustic standing wave is contained in the resonant pressure vessel, which is about half the length of the wavelength of the standing wave. An acoustic driver cyclically drives the fluid with an acoustic standing wave. The acoustic driver is disposed at a location of maximum acoustic impedance in the resonant pressure vessel. A thermodynamic element is located in the resonant pressure vessel near but spaced-apart from the acoustic driver, is in thermal communication with the fluid and is thermally responsive to the acoustic standing wave. The thermodynamic element serves the function of the second thermodynamic medium of the '553 patent. The thermodynamic element has a first end located proximate the acoustic driver and a second end located opposite the first end and away from the driver. The thermal response of the thermodynamic element to the acoustic standing wave pumps heat from its second end to its first end. The thermodynamic element has a length substantially less than one-fourth the wavelength of the acoustic standing wave. A hot heat exchanger is in thermal communication with and adjacent to the first end of the thermodynamic element. The hot heat exchanger conducts heat from the first end of the thermodynamic element to portions of the resonant pressure vessel proximate said hot heat exchanger.

In a preferred embodiment of the invention the acoustic cooling engine includes a heat sink thermally coupled to the hot heat exchanger. The heat sink is located outside of the resonant pressure vessel and receives heat from the hot heat exchanger. A cold heat exchanger is in thermal communication with the second end of the thermodynamic element. The cold heat exchanger is thermally coupled to and cools a load which can be located outside of the resonant pressure vessel. Both the cold and the hot heat exchangers permit substantial flow of the fluid therethrough. An improvement in the performance of the acoustic cooling engine of the present invention is obtained by modifying the half-wavelength long resonant pressure vessel described earlier. In the preferred embodiment, the resonant pressure vessel comprises an elongated housing with first and second ends and a reservoir in fluid communication with and sealably engaging the second end of the housing. The housing is a cylindrical tube with a larger diameter portion and a smaller diameter portion substantially smaller in diameter than the larger diameter portion. The thermodynamic element and hot heat exchanger are located inside the larger diameter portion. The thermodynamic element can be a plurality of elongated spaced-apart plates extending parallel to the longitudinal axis of said housing. In all embodiments described herein, the thermodynamic element permits substantial fluid flow therethrough. The cold heat exchanger is adjacent to the junction of the larger and smaller diameter portions. The housing has a length of less than one-fourth the wavelength of the acoustic standing wave. The fluid, a gas such as helium, is maintained at a pressure substantially above atmospheric pressure, and is driven by the acoustic driver at a resonant frequency. The resonance condition is defined by that frequency for which the ratio of acoustic pressure to acoustic velocity, the acoustic impedance, at the first end of the housing and adjacent to the driver, is highest. The acoustic pressure and velocity are then necessarily in phase at this point. Pressure and acceleration measuring devices and controlling electronics are included in the acoustic cooling engine to ensure that this phase relationship exists during engine operation. Thus, the driver is placed at a point of high acoustic impedance. In comparison, the acoustic heat pumping engine disclosed in the '553 patent places the driver at a point of low acoustic impedance.

One advantage of the present invention is that the second end of the thermodynamic element and those components in thermal contact with it, the cold heat exchanger, the smaller diameter portion of the housing, and the reservoir, can be thermally isolated from the driver. An additional advantage of the preferred embodiment is that the cold portions of the resonant pressure vessel, the smaller diameter portion of the housing and the reservoir, exhibit substantially less acoustic loss than a comparably designed resonant pressure vessel consisting of a constant diameter tube, such as a half-wavelength long tube. This acoustic loss constitutes an internally generated heat source. Both the thermal isolation from the driver and the lower acoustic loss result in substantially lower internal heating loads on the thermodynamic element. This enables the acoustic cooling engine to achieve a lower temperature in the absence of an external load to be cooled, and either higher efficiency or a lower temperature in the presence of an external load, as compared to known acoustic cooling engines.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate several embodiments of the present invention and, together with the description, serve to explain the principles of the invention. In the drawings.

DETAILED DESCRIPTION OF THE INVENTION

Figure 1:
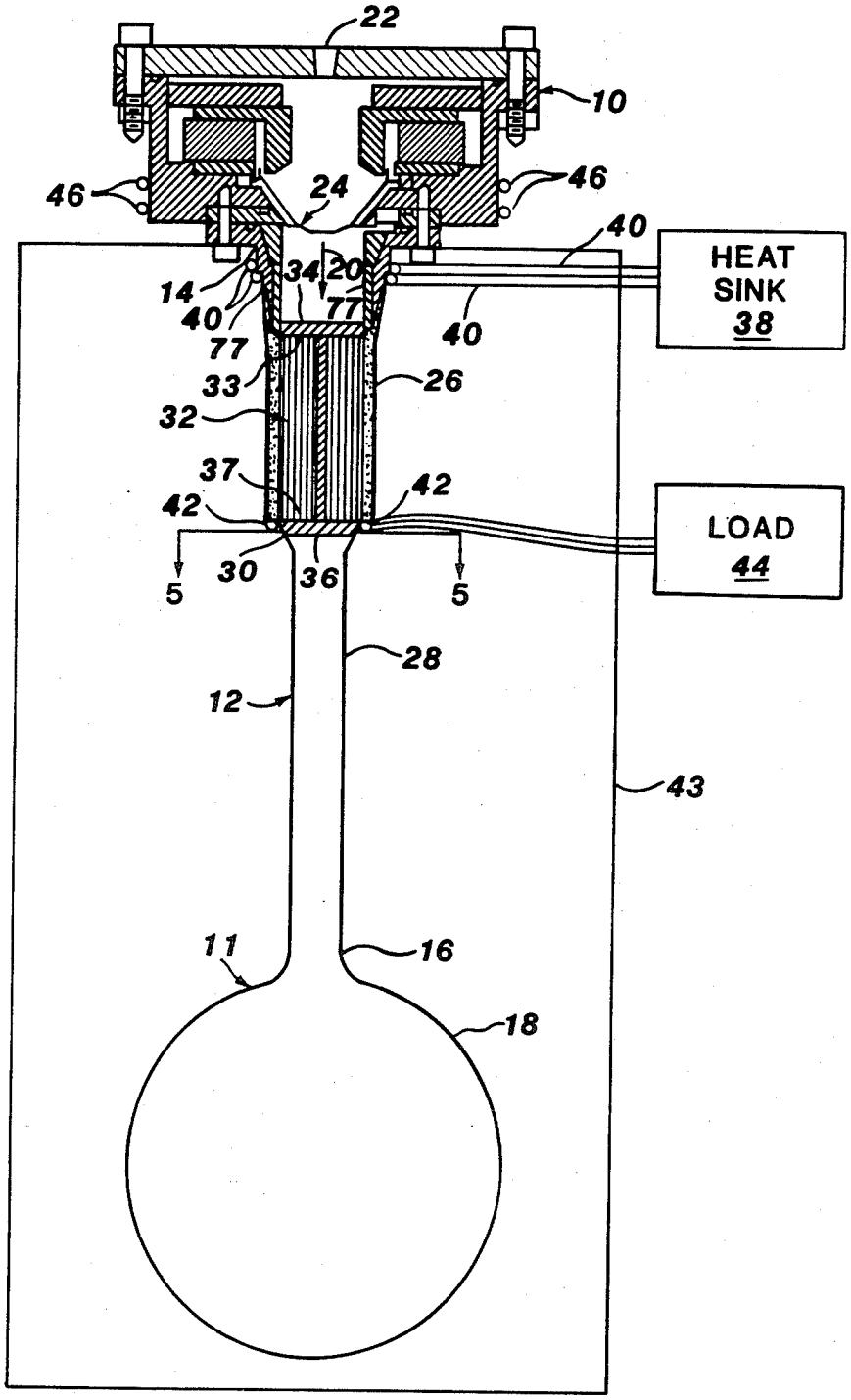
FIG. 1 shows a cross-sectional view of a preferred embodiment of the invention.

Reference is now made to FIG. 1 which shows a cross-sectional view of a preferred embodiment of the acoustic cooling engine 10 of the present invention. The acoustic cooling engine 10 includes a resonant pressure vessel 11. Resonant pressure vessel 11 can be an elongated housing 12, having a first end 14 and a second end 16, and a reservoir 18. Reservoir 18 can be a hollow metal sphere, with a volume of about one liter, which sealably engages second end 16. A compressible fluid represented by arrow 20 is capable of supporting an acoustic standing wave and has a substantial thermal expansion coefficient. The compressible fluid is contained in housing 12 and in reservoir 18. The compressible fluid is preferably a gas such as $^4$He, but those skilled in the art will appreciate that other liquids or gases could be used. The gas is introduced into engine 10 through port 22 and can be kept at a pressure substantially above atmospheric pressure. A mean pressure of 10.3 bar with $^4$He was used in obtaining cooling to −73° C. with this preferred embodiment of the acoustic cooling engine 10.

An acoustic driver 24 cyclically drives the gas with a resonant acoustic standing wave at a sufficiently low frequency that the length of housing 12 is less than one-fourth the wavelength of the acoustic standing wave. The pressure exerted by driver 24 and the velocity of the driver 24 are in phase, so work is performed by driver 24 on the gas. Preferably the frequency is a resonant frequency in the range of 530 Hz to 590 Hz.

Housing 12 is preferably a cylindrical tube including a larger diameter portion 26 and a smaller diameter portion 28, which is substantially smaller in diameter than larger portion 26. The inside diameter of larger portion 26 is 38.1 mm. The inside diameter of smaller portion 28 is 22.1 mm. Larger portion 26 is an epoxy fiberglass tube with walls about 2 mm thick. Smaller portion 28 is a copper tube with walls about 3 mm thick. At the junction 30 between larger portion 26 and smaller portion 28, there is a reduction in the diameter of housing 12, with a slope of about 45°. This reduction in diameter resulted in an unexpected improvement in the performance of the acoustic cooling engine 10. Preferably housing 12 is about one-fifth the length of the wavelength of the acoustic standing wave.

A thermodynamic element 32 is located in larger portion 26 of housing 12. Thermodynamic element 32 is spaced-apart from but near acoustic driver 24. Thermodynamic element 32 includes a first end 33, which is hereinafter referred to as the hot end 33 and which is the end closer to and proximate the acoustic driver 24, and a second end 37, hereinafter the cold end 37, opposite the hot end 33 and driver 24. Thermodynamic element 32 is thermally responsive to the acoustic standing wave and pumps heat from cold end 37 to hot end 33. If thermodynamic element 32 is located closer to acoustic driver 24, the acoustic cooling engine 10 can reach lower temperatures, but it will have less cooling power. Thermodynamic element 32 has a heat capacity within a thermal penetration depth of the boundary of the thermodynamic element 32 and the gas, larger than the heat capacity of the gas within a thermal penetration depth of the boundary of the thermodynamic element 32 and the gas. A thermal penetration depth is defined in U.S. Pat. No. 4,489,553 at column fourteen. Thermodynamic element 32 is substantially shorter than one-fourth the wavelength of the acoustic standing wave.

In the preferred embodiment shown, acoustic cooling engine 10 includes a heat sink 38 located outside of housing 12 and thermally coupled to a hot heat exchanger 34 by first conduits 40 and metal portions 77. Cold water is circulated through first conduits 40. Hot heat exchanger 34 is adjacent to and in thermal communication with hot end 33 of thermodynamic element 32. A cold heat exchanger 36 can be adjacent to and in thermal communication with cold end 37. Cold heat exchanger 36 is adjacent to junction 30. Hot heat exchanger 34 conducts heat from hot end 33 to metal portions 77. Hot heat exchanger 34 and cold exchanger 36 can each have a coefficient of thermal conductivity substantially greater than the coefficient of thermal conductivity of thermodynamic element 32. Heat sink 38 is also located outside of a vacuum vessel 43 which surrounds and insulates housing 12 and reservoir 18. Housing 12 and reservoir 18 are also insulated with fifteen layers of superinsulation (not shown), which consists of aluminized Mylar film.

A load 44 to be refrigerated can be placed in mechanical thermal contact with cold heat exchanger 36, either on the outside or inside of housing 12. Alternatively, a suitable cold fluid is circulated through second conduits 42 which are coupled to cold heat exchanger 36 and serve as a thermal communication device between cold heat exchanger 36 and load 44. Load 44 is cooled by acoustic cooling engine 10. Load 44 is shown located outside of vacuum vessel 43. It is not essential to the operation of acoustic cooling engine 10 to use a cold heat exchanger 36.

Acoustic driver 24 is, to the extent possible, thermally isolated from cold end 37. To remove heat from acoustic driver 24, cold water can be circulated through third conduits 46. Removing heat generated by acoustic driver 24 enables higher acoustic amplitudes and powers to be obtained while protecting voice coil 56, shown in FIG. 2, from burnout.

Figure 2:
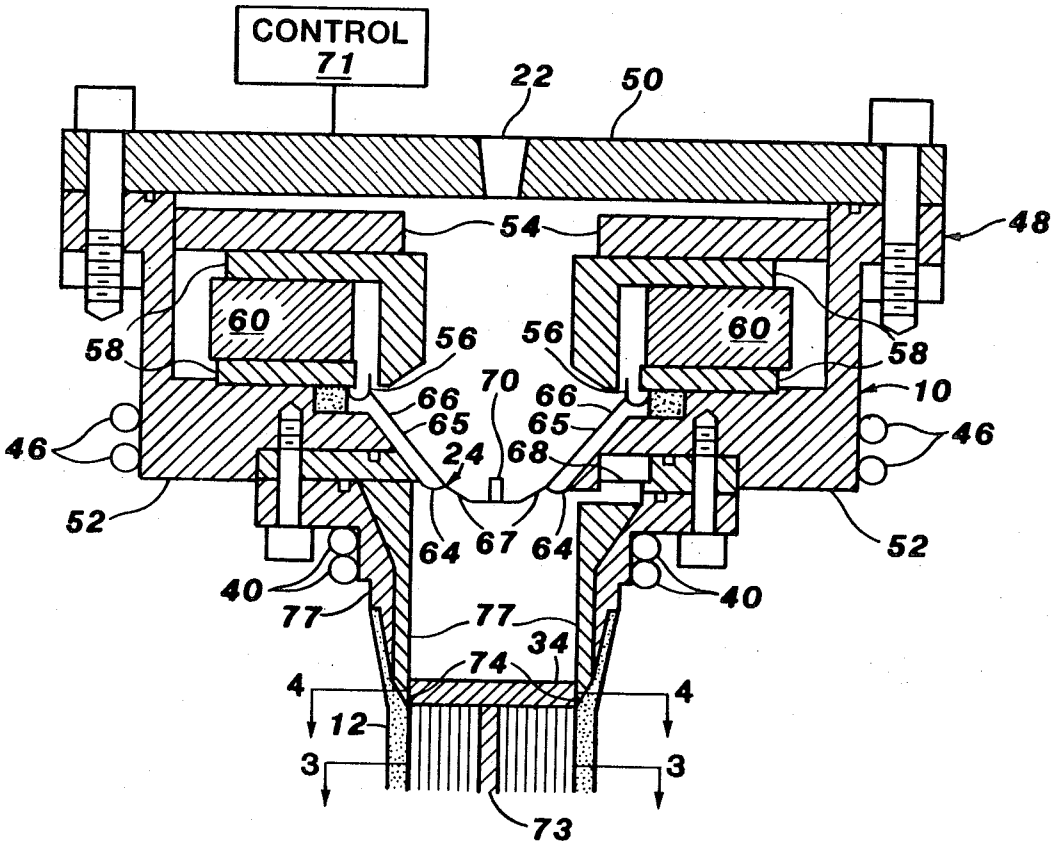
FIG. 2 shows an enlarged cross-sectional view of portions of the embodiment shown in FIG. 1.

Reference is now made to FIG. 2 which shows an enlarged cross-sectional view of portions of the embodiment of the acoustic cooling engine 10 shown in FIG. 1. Acoustic driver 24 is located in a pressure vessel 48. Pressure vessel 48 includes an aluminum cover plate 50 in which port 22 is located. Pressure vessel 48 also includes a bottom vessel 52 and a driver clamp 54 which serve as heat sinks. Acoustic driver 24 is a Dynaudio D-b 54, 2-in. dome mid-range driver made in Denmark. Acoustic driver 24 includes voice coil 56, pole pieces 58 and a magnet 60. Surround 64 is made of epoxy-impregnated cloth for flexibility. The cloth dome of the commercial acoustic driver 24 was cut off near the voice coil 56 and replaced by a 0.3 mm wall aluminum driver cone 66 having two tapers. The first taper 65 achieves a desired diameter reduction, to better match the driver impedance to the resonator impedance. Both first taper 65 and second taper 67 enhance rigidity. A Y-cut quartz microphone 68 measures acoustic pressure. A transducer 70 is located on aluminum driver cone 66 and measures acceleration. The time phase between the microphone 68 signal and the acceleration signal is measured and used in a feedback circuit, control 71, to control the driver 24 frequency. The driver 24 frequency is controlled so as to maintain the acoustic pressure and acoustic velocity in phase near the driver cone 66, thus maintaining resonance, regardless of the temperature distribution within acoustic cooling engine 10. Control 71 is connected to driver 24, transducer 70 and microphone 68 by wiring which is not shown. A capillary, not shown, permits the gas to move from port 22 into housing 12.

Figure 3:
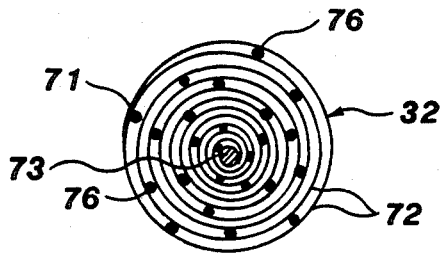
FIG. 3 shows a plan view in cross section of portions of the embodiment shown in FIG. 2, taken along section line 3—3 of FIG. 2.

Reference is now made to FIG. 3 which shows a plan view in cross section of a preferred embodiment of thermodynamic element 32, taken along section line 3—3 of FIG. 2. Thermodynamic element 32 is made from a nonmetallic material, such as, 244 cm long by 78.5 mm wide sheet 71 of 0.076 mm thick DuPont Kapton-H® film. The sheet 71 was wound in a spiral with layers 72 on a 6.4 mm diameter cloth phenolic rod 73. Dots 76 represent 0.38 mm diameter nylon cylinders (monofilament fishing line) which serve as spacers. The cylinders are attached to and separate layers 72.

Figure 4:
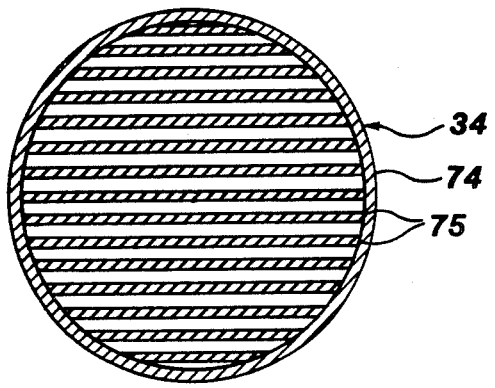
FIG. 4 shows a plan view in cross section of portions of the embodiment shown in FIG. 2, taken along section line 4—4 of FIG. 2.

Reference is now made to FIG. 4 which shows a plan view in cross section of a preferred embodiment of hot heat exchanger 34, taken along section line 4—4 of FIG. 2. Hot heat exchanger 34 includes a copper ring 74 and sixty copper strips 75, fifteen of which are shown for ease of illustration. Copper ring 74 is soldered into metal portions 77, shown in FIG. 2. Each copper strip 75 is 6.4 mm wide and 0.25 mm thick. They are equally spaced-apart from each other with a separation of 0.38 mm.

Figure 5:
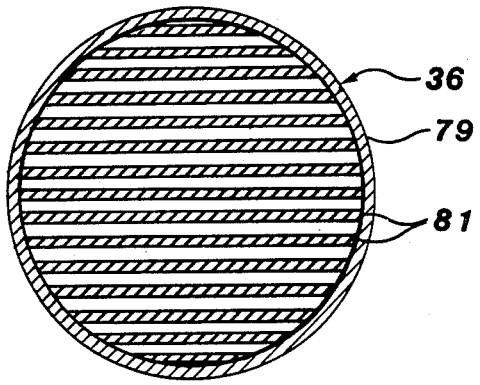
FIG. 5 shows a plan view in cross section of portions of the embodiment shown in FIG. 1, taken along section line 5—5 of FIG. 1.

Reference is now made to FIG. 5, which shows a plan view in cross section of a preferred embodiment of cold heat exchanger 36, taken along section line 5—5 of FIG. 1. Cold heat exchanger 36 includes a copper ring 79 and fifty copper strips 81, fifteen of which are shown for ease of illustration. Each copper strip 81 is 2.5 mm wide and 0.25 mm thick. They are equally spaced-apart from each other with a separation of 0.51 mm. Metal structures other than cold heat exchanger 36, such as a cross of stainless steel strips (not shown), can be used as a support for thermodynamic element 32. When the load 44 to be cooled is small, a cold heat exchanger 36 is not needed.

Figure 6:
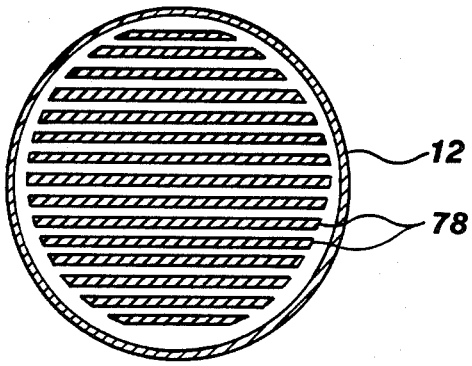
FIG. 6 shows a plan view in cross section of portions of another embodiment of the invention.
Figure 7:
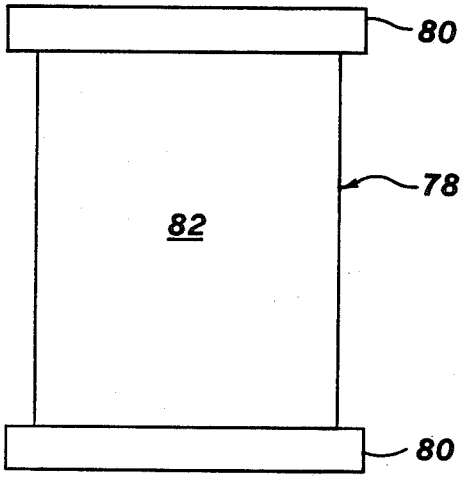
FIG. 7 shows a side elevational view of a single plate of the embodiment shown in FIG. 6.

Reference is now made to FIG. 6, which shows a plan view in cross section of portions of another embodiment of the invention. In this embodiment, a series of spaced-apart plates 78 serve the functions of hot heat exchanger 34, thermodynamic element 32 and cold heat exchanger 36, all shown in FIG. 1. Each plate 78, as shown in FIG. 7, has end portions 80 of metal and a central portion 82 made of a non-metallic material, such as fiberglass. The end portions 80 serve as hot heat exchanger 34 and cold heat exchanger 36. The central portions 82 serve as thermodynamic element 32.

The main problem with the acoustic heat pumping engine disclosed in the '553 patent is that there is significant internal heating. There are two sources of internal heating. First, the cold ends of the plates are in thermal contact with the warm driver via acoustically driven convective flows in the gas and second, the acoustic losses generated between the plates and the driver are an internal heat source. The source of thermal contact can be eliminated by using any resonant pressure vessel geometry wherein the hot ends of the plates, rather than the cold ends, are closer to the driver and wherein the plates are in the proper position relative to the standing wave. With this arrangement the entire portion of the resonant pressure vessel opposite the cold ends of the plates is cooled, so all of the acoustic losses generated in this portion cause internal heating. These acoustic losses then become the dominant problem in producing low temperatures.

Figure 8:
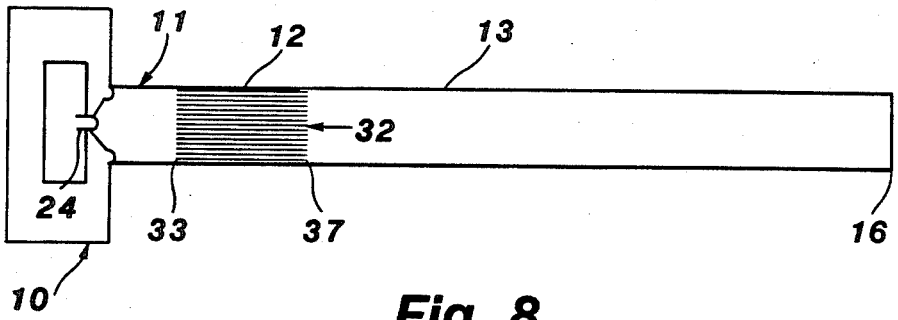
FIGS. 8 through 10 show schematic cross-sectional views of three acoustic cooling engines with different resonant pressure vessel configurations.
Figure 9:
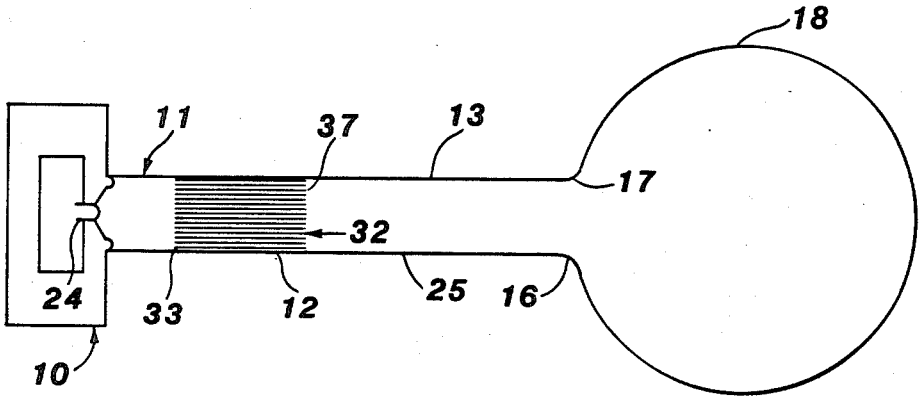
Figure 10:
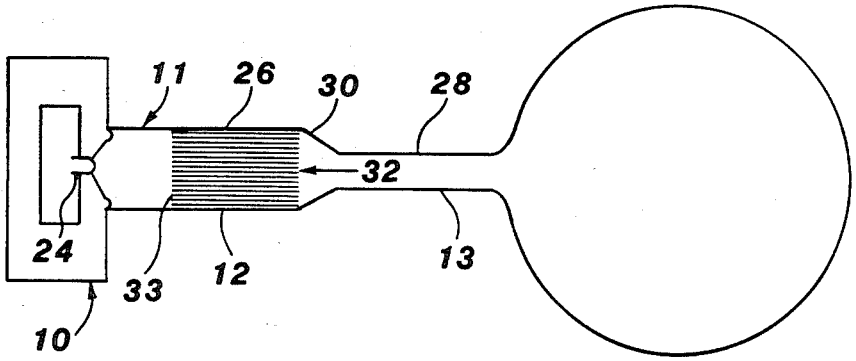

To understand better the acoustic loss problem and how the present invention minimizes it, consider three different resonant pressure vessel 11 geometries, shown in FIGS. 8, 9, and 10, all having the hot end 33 of thermodynamic element 32 proximate the driver 24. All three acoustic cooling engines 10 have the driver 24 positioned at a pressure antinode, a local maximum, of the standing wave. The resonant pressure vessel 11 shown in FIG. 8 has a housing 12 that is half a wavelength long and of uniform diameter. A cold portion 13 extends from cold end 37 to second end 16 of housing 12. Cold portion 13 has acoustic losses that are a substantial fraction of the total cooling power of the acoustic cooling engine 10. For small acoustic amplitudes, both the cooling power and the resonant pressure vessel 11 losses are proportional to the square of the amplitude. The acoustic cooling engine 10 shown in FIG. 9 has a quarter-wavelength long housing 12, including a cold section 25 extending from the vicinity of cold end 37 to coupling 17, and a reservoir 18 large enough so that it produces an effective open end condition at the coupling 17 between reservoir 18 and the second end 16 of housing 12. The reservoir 18 of FIG. 9 effectively replaces half of the housing 12 of FIG. 8 and effectively eliminates half of the losses associated with housing 12 of FIG. 8, ignoring the losses of the reservoir 18 of FIG. 9. Thus the losses associated with cold portion 13 of FIG. 9 are substantially less than half of the losses associated with cold portion 13 of FIG. 8. The losses of reservoir 18 can be made almost arbitrarily small by making it larger, with the surface integral of the acoustic pressure squared being inversely proportional to the fourth power of the linear dimensions of reservoir 18. Also, the losses associated with the coupling 17 transition itself are ignored here. The losses associated with the cold portion 13 of the resonant pressure vessel 11 are further reduced in FIG. 10 where housing 12 has a larger diameter portion 26 and a smaller diameter portion 28. The preferred embodiment of the present invention has this geometry.

That the resonant pressure vessel 11 of FIG. 10 has lower losses than that of FIG. 9, in the cold portion 13, is surprising and non-intuitive. This relationship can be understood by considering the geometry of FIG. 9 and reducing the cold section 25 diameter, holding the frequency and the pressure amplitude near driver 24 constant and changing the cold section 25 length to maintain resonance. The naive assumption might be that the losses are proportional to the velocity squared, and thus higher with the geometry of FIG. 10 than with the geometry of FIG. 9.

For the geometry of FIG. 10, losses are minimized for a particular diameter of smaller portion 28. The viscous losses are in fact proportional to the core velocity squared times the smaller portion 28 circumference, integrated over the smaller portion 28 length. As the diameter shrinks, starting at the larger diameter, the mean squared velocity, averaged over the smaller portion 28 length, actually increases very slowly at first and then more rapidly at smaller diameters. Also, the length of the smaller portion 28 decreases quickly with diameter. Consequently, the product of mean squared velocity, smaller portion 28 circumference and smaller portion 28 length decreases at first, reaches a minimum, and then increases at small diameters when the mean squared velocity is increasing rapidly. In addition to viscous losses, there are acoustic losses that are thermodynamic in origin and are related to the local dynamic pressure, rather than to the velocity. A qualitative view of these losses is even less intuitive, although a mathematical treatment indicates that they decrease rapidly as the diameter of smaller portion 28 decreases. The preferred embodiment of the present invention is a resonant pressure vessel 11 with a geometry for which these losses have been minimized.

Figure 11:
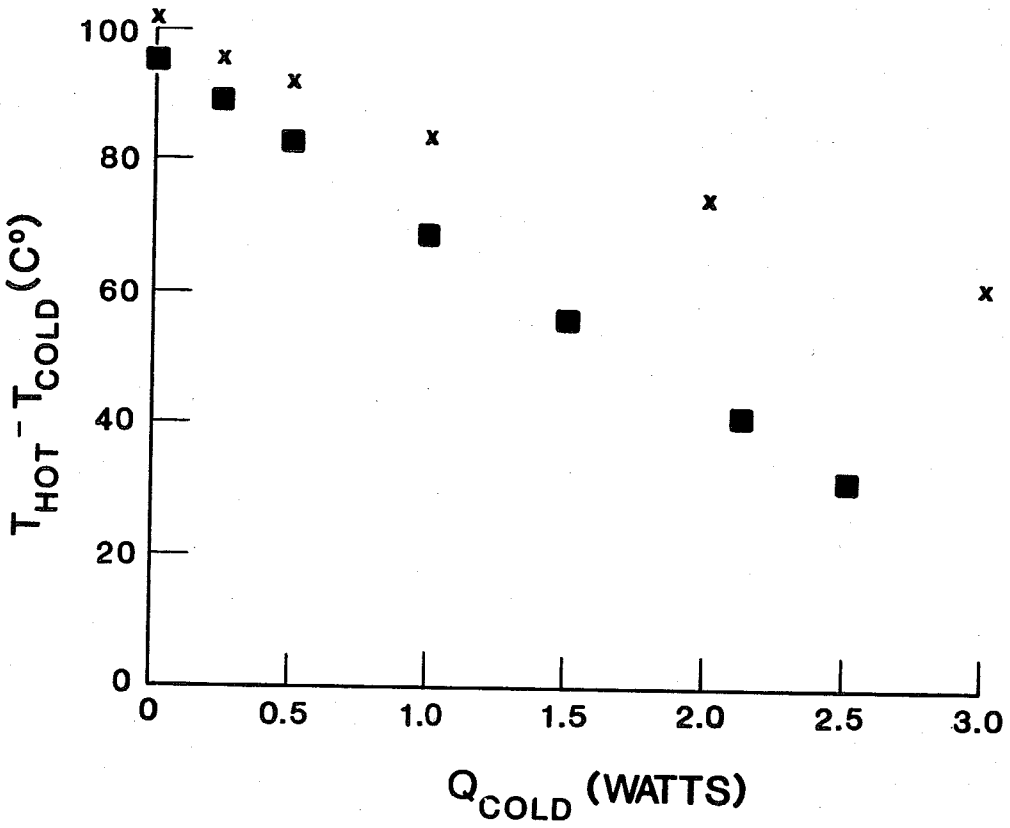
FIG. 11 graphically illustrates the temperature difference achieved by an embodiment of the invention versus refrigeration available at the cold end of the embodiment.

Reference is now made to FIG. 11 which graphically illustrates the temperature difference achieved by an embodiment of the acoustic cooling engine 10 versus refrigeration available at the cold end 37. Load 44 was an electric heater directly attached to housing 12 proximate cold heat exchanger 36. Otherwise, the acoustic cooling engine 10 used was the preferred embodiment of the invention. The vertical axis shows, in Celsius degrees, the temperature difference achieved between the hot heat exchanger 34, $T_{HOT}$, and the cold end 27, $T_{COLD}$. The horizontal axis shows, in watts, the power supplied to the load 44 which was cooled. There are two data plots shown. The squares correspond to a $p_o/p_m$ ratio of 0.02, where $p_o$ is the peak dynamic pressure amplitude and $p_m$ is the mean pressure at which the helium gas was maintained. The x's correspond to a $p_o/p_m$ ratio of 0.03. For the data obtained, $p_m$ was 10.3 bar helium, $T_{HOT}$ was 26° C. and the frequency was between 530 and 590 Hz. The data in FIG. 11 show that there is more cooling capacity when the acoustic cooling engine 10 is driven harder and that, as the load 44 to be cooled is increased, the temperature difference achieved decreases.

The foregoing description of several embodiments of the invention has been presented for purposes of illustration and description. It is not intended to be exhaustive or to limit the invention to the precise forms disclosed. They were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An acoustic cooling engine comprising:

container means for containing a compressible fluid which is capable of supporting and acoustic standing wave having a selected wavelength, said container means having two ends defining a length about half said wavelength of said acoustic standing wave;

driver means for cyclically driving said compressible fluid at a frequency corresponding to said selected wavelength, said driver means being positioned at one of said ends of said container means, said one end being a location of maximum acoustical impedance;

a thermodynamic element located in said container means and having a first end proximate to said driver means and a second end located further away from said driver means than said first end and defining a length less than one-fourth said wavelength of said acoustic standing wave, said thermodynamic element being thermally responsive to said acoustic standing wave to cause heat to be pumped from said second end to said first end thereby thermally isolating said second end from said driver means; and conductor means for conducting heat away from said first end of said thermodynamic element.

2. The acoustic cooling engine of claim 1 wherein said container means comprises:

an elongated cylindrical tube having a first closed end and a second end, said driver means being positioned at said second end.

3. The acoustic cooling engine of claim 1 wherein said thermodynamic element comprises a rod, a sheet of nonmetallic material wound in a spiral configuration around said rod, and a plurality of cylinders attached to said sheet which serve as spacers.

4. The acoustic cooling engine of claim 1 further comprising a first heat exchanger adjacent to and in thermal communication with said second end of said thermodynamic element.

5. The acoustic cooling engine of claim 1 wherein said heat conductor means is a second heat exchanger adjacent to and in thermal communication with said first end of said thermodynamic element.

6. The acoustic cooling engine of claim 1 wherein said driver means comprises:

a pressure vessel;

an acoustic driver located in said pressure vessel, said acoustic driver comprised of an aluminum driver cone having two separate tapers which enhance the rigidity of said acoustic driver; and controller means for controlling the frequency of said acoustic driver.

7. An acoustic cooling engine comprising:

an elongated housing having a first end and a second end;

a reservoir sealably engaged to said second end of the housing, said elongated housing having a length less than one-fourth of a wavelength of an acoustic standing wave generated at a selected frequency in a compressible fluid contained in said reservoir and said housing;

driver means for cyclically driving said compressible fluid at said frequency which produces the acoustic standing wave, said driver means being positioned at said first end of the elongated housing which is a location of maximum acoustical impedance;

a thermodynamic element located in said elongated housing, said thermodynamic element having a first end proximate to said driver means and a second end located further away from said driver means than said first end, said thermodynamic element having a length less than one-fourth of said wavelength of said acoustic standing wave, said thermodynamic element being thermally responsive to said produced acoustic standing wave to cause heat to be pumped from said second end to said first end thereby thermally isolating said second end from said driver means; and conductor means for conducting heat away from said first end of said thermodynamic element.

8. The acoustic cooling engine of claim 7 wherein said thermodynamic element comprises a rod, a sheet of nonmetallic material wound in a spiral configuration around said rod, and a plurality of nylon cylinders attached to said sheet which serve as spacers.

9. The acoustic cooling engine of claim 7 further comprising a first heat exchanger adjacent to and in thermal communication with said second end of said thermodynamic element.

10. The acoustic cooling engine of claim 7 wherein said heat conductor means is a second heat exchanger adjacent to and in thermal communication with said first end of said thermodynamic element.

11. The acoustic cooling engine of claim 7 wherein said driver means comprises:

a pressure vessel;

an acoustic driver located in said pressure vessel, said acoustic driver comprised of an aluminum driver cone having two separate tapers which enhance the rigidity of said acoustic driver; and controller means for controlling the frequency of said acoustic driver.

12. The acoustic cooling engine of claim 7 wherein said elongated housing is a cylindrical tube and said reservoir is a hollow sphere.

13. An acoustic cooling engine comprising:

a cylindrical tube having a larger diameter portion defining a first end of said tube and a smaller diameter portion defining a second end of said tube:

a reservoir sealably engaged to said second end of said tube, said cylindrical tube having a length less than one-fourth of a wavelength of an acoustic standing wave generated at a selected frequency in a compressible fluid contained in said tube and said reservoir;

driver means for cyclically driving said fluid at a frequency effective to produce said acoustic standing wave, said driver means being positioned at said first end of the cylindrical tube which is a location of maximum acoustical impedance;

a thermodynamic element located in said cylindrical tube, said thermodynamic element having a first end proximate to said driver means and a second end located further away from said driver means than said first end, said thermodynamic element having a length less than one-fourth of said wavelength of said acoustic standing wave, said thermodynamic element being thermally responsive to said acoustic standing wave to cause heat to be pumped from said second end to said first end thereby thermally isolating said second end from said driver means; and conductor means for conducting heat away from said first end of said thermodynamic element.

14. The acoustic cooling engine of claim 13 wherein the length of said cylindrical tube is about one-fifth of said wavelength of an acoustic standing wave.

15. The acoustic cooling engine of claim 13 wherein said thermodynamic element is located in the larger diameter portion of said cylindrical tube.

16. The acoustic cooling engine of claim 13 wherein said thermodynamic element comprises a rod, a sheet of nonmetallic material wound in a spiral configuration around said rod, and a plurality of cylinders attached to said sheet which serve as spacers.

17. The acoustic cooling engine of claim 13 further comprising a first heat exchanger adjacent to and in thermal communication with said second end of said thermodynamic element.

18. The acoustic cooling engine of claim 13 wherein said conductor means is a second heat exchanger adjacent to and in thermal communication with said first end of said thermodynamic element.

19. The acoustic cooling engine of claim 13 wherein said driver means comprises:

a pressure vessel;

an acoustic driver located in said pressure vessel, said acoustic driver comprised of aluminum driver cone having two separate tapers which enhance the rigidity of said acoustic driver; and controller means for controlling the frequency of said acoustic driver.

20. The acoustic cooling engine of claim 13 wherein said smaller diameter portion and said larger diameter portion define a juncture therebetween having a slope of about 45°.

21. The acoustic cooling engine of claim 13 wherein said thermodynamic element is comprised of a plurality of elongated spaced-apart plates extending parallel to the longitudinal axis of said cylindrical tube.

* * * * *